US007441718B2

(12) United States Patent
Seaman et al.

(10) Patent No.: US 7,441,718 B2
(45) Date of Patent: Oct. 28, 2008

(54) WOOD REDUCING APPARATUS HAVING HYDRAULICALLY CONTROLLED MATERIAL FEED SYSTEM

(75) Inventors: Tony H. Seaman, Sumner, MI (US); Daniel J. Schumacher, Weidman, MI (US)

(73) Assignee: Morbark, Inc., Winn, MI (US)

( * ) Notice: Subject to any disclaimer, the term of this patent is extended or adjusted under 35 U.S.C. 154(b) by 287 days.

(21) Appl. No.: 10/319,367

(22) Filed: Dec. 13, 2002

(65) Prior Publication Data

US 2003/0111566 A1 Jun. 19, 2003

Related U.S. Application Data

(60) Provisional application No. 60/339,738, filed on Dec. 13, 2001.

(51) Int. Cl.
*B02C 25/00* (2006.01)

(52) U.S. Cl. ..... 241/34; 241/92

(58) Field of Classification Search ..... 241/34, 241/92, 35; 144/176
See application file for complete search history.

(56) References Cited

U.S. PATENT DOCUMENTS 4,625,924 A 12/1986 Killinger
5,020,579 A * 6/1991 Strong ..... 144/176
5,020,759 A * 6/1991 Weber ..... 248/309.2
5,148,844 A 9/1992 Robison
5,205,496 A * 4/1993 O'Donnell et al. ..... 241/34
5,322,104 A 6/1994 Morey et al.
5,419,502 A 5/1995 Morey
5,881,959 A * 3/1999 Hadjinian et al. ..... 241/34
6,474,579 B1 11/2002 Bardos et al.

* cited by examiner

*Primary Examiner*—Mark Rosenbaum
(74) *Attorney, Agent, or Firm*—Reising, Ethington, Barnes, Kisselle, P.C.

(57) ABSTRACT

A wood chipper or grinder includes counter rotating upper and lower feed drums driven by a hydraulic motor at variable fluid pressure to produce variable torque to the feed drums. Wood debris fed to a gap between the rollers is advanced toward a grinder or chipper to reduce the material. A hydraulic feed control system operates off the variable hydraulic pressure associated with the motor and, in an automatic mode, exerts more or less downward clamping pressure on the upper feed drum with changes in pressure to the motor. The system sets an upper limit on the clamping pressure in the automatic mode which can be overridden manually if necessary to apply greater downward force than that achievable in the automatic mode. The upper feed drum can also be manually raised if necessary.

11 Claims, 5 Drawing Sheets

WOOD REDUCING APPARATUS HAVING HYDRAULICALLY CONTROLLED MATERIAL FEED SYSTEM

The application claims the priority of U.S. Provisional Application 60/339,738, filed Dec. 13, 2001.

BACKGROUND OF THE INVENTION

1. Technical Field

This invention relates generally to wood reducing apparatus of the type used to reduce trees, limbs, and other wood debris into chips or grindings by advancing the material into the path of a rotating chipping or grinding drum or disc, and more particularly to automated feed systems for such wood reducers which engage and advance the material for chipping or grinding.

2. Related Art

There are various devices known in the art used for reducing trees, tree limbs, and other scrap wood products such as wood pallets and the like into chips or grindings. The material is introduced into a feed chute and advanced against a rotating reducing drum or wheel driven within a chamber downstream of the feed chute, which carries a series of spaced knives or teeth that cut or shred the material into chips or grindings.

Such apparatus are typically equipped with a power driven feed system located in a throat of the feed chute upstream of the rotating reducing drum or wheel which operates to engage and advance the material toward the reducer. One such feed system 11 employed in various prior art wood chipping apparatus 13 (portable and stationary equipment) manufactured by the assignee of the present invention is illustrated in FIGS. 1 and 2, and includes a set of opposed feed drums 15, 17 which are mounted in the throat 19 of the apparatus 13. The drums 15, 17 are counter rotating and power driven by hydraulic motors which operate to positively drive the upper and lower drums 15, 17 in opposite directions away from the feed chute for drawing the wood feed material into a feed gap 21 between the upper and lower feed drums 15, 17. The upper feed drum 15 is mounted on a swing arm 23 which straddles the chipping chamber and is pivoted to the frame 25 of the apparatus 13 by pivot mount 27, enabling the upper feed drum 15 to be displaced relative to the lower feed drum 17 in order to vary the gap 21 between the drums 15, 17 to enable feed material of varying diameter and bulk to be fed to the gap 21 between the drums 15, 17. The enlarged fragmentary view of FIG. 2 shows the feed drum 15 in a fully lowered position (solid lines) and a fully-raised position (broken chain lines). Tension springs 29 (only one shown) are connected to the frame 25 of the apparatus 13 at their lower end on opposite sides of the chipping chamber and are coupled to the movable swing arm 23 at their upper ends outwardly of the pivot mount 27. The springs 29 act to urge the swing arm 23 downwardly, and thus constantly bias the upper feed drum 15 to the fully lowered solid line position.

As feed material is presented to the gap 21, the upper feed drum 15 rides on top of the material and thus widens the gap 21 to enable the material to pass between the drums 15, 17. The upward movement of the feed drum 15 is counteracted by the downward tension force exerted by the springs 29. The tension springs 29 thus apply a certain compression load on the material being fed into the gap 21. Under most conditions, the force applied by the tension springs 29 is sufficient to grip the material firmly enough to draw the material into the rotating chipper mechanism 31. However, due to the inherent spring constant characteristic of a tension spring 29, the closing compression force exerted by the springs 29 varies with the position of the swing arm 23, such that the tension springs 29 provide far less compression force when the upper feed drum 15 is at or near the fully lowered solid line position and increases when the gap 21 is opened through movement of the feed drum 15 toward the broken line raised position of FIG. 2. Consequently, when the material fed to the gap 21 is relatively small, such as small tree branches and the like, the tension springs 29 may not provide sufficient compression force to grip and draw the material into the rotating chipper 31 without slipping.

A pair of hydraulic cylinders 33 are connected at their lower end to the frame 25 on opposite sides of the chipping chamber (only one shown) and at their upper end to the swing arm 23 outwardly of the pivot mount 27. The cylinders 33 have a set of upper and lower feed/return lines 35, 37 which communicate with the upper and lower ends of the cylinders 33 and are coupled to a manually operable valve bank 39. The valve bank operates manually via a lever 41 to position the cylinders 33 in either a neutral position in which hydraulic fluid is permitted to flow freely into and out of both ends of the cylinders such that the cylinders 33 do not exert any substantial resistance to the raising or lowering of the swing arm 33, but go along for the ride, or hydraulic fluid under pressure may be pumped into the lower end of the cylinders 33 to manually raise the upper feed drum 15 in the event that the incoming feed material is awkwardly shaped or otherwise the upper feed drum 15 requires manual assistance from the hydraulic cylinders 33 to raise the feed drum 15 high enough to climb on top of the feed material, or to manually feed pressurized hydraulic fluid into the upper end of the cylinders 33 to urge the upper feed drum 15 downwardly. In normal operation, the cylinders 33 are maintained in the neutral position and thus do not play any role in applying a compressive gripping force to the incoming feed material, with the feed mechanism 11 being relied instead on the tension springs 29. Accordingly, this prior art feed system 11 is reliant for automatic feed entirely upon the clamping force applied by the tension springs 29 for gripping the wood material fed to the gap 21, and the hydraulic cylinder comes into play only with manual input from the operator to either raise or lower the upper feed drum 15.

It is an object of the present invention to overcome the inherent limitations presented by the tension spring-type automatic feed mechanism for wood reducing apparatus while retaining the capability of manually raising the upper feed drum to accommodate the introduction of very large or awkward feed material to the gap between the feed drums.

SUMMARY OF THE INVENTION AND ADVANTAGES

According to the invention, a wood reducing apparatus for reducing wood scrap such as tree limbs, branches, wood pallets and the like to chips or grinding comprises a set of counter rotating feed drums mounted in a throat of a feed chute of the apparatus ahead of a wood reducing mechanism mounted within a chamber of the apparatus. The upper feed drum is supported for pivoting movement relative to the lower feed drum in order-to vary the size of a feed gap defined between the drums. The upper feed drum is coupled to a hydraulic motor driven by a supply of hydraulic fluid that varies in pressure with changing loads on the feed drum. At least one hydraulic cylinder is mounted on the frame of the apparatus and is operatively coupled to the upper feed drum. A hydraulic feed control system communicates with the cylinder and with the supply of hydraulic fluid and is operative in an automatic mode to supply pressurized hydraulic fluid to one end of the cylinder in order to effect application of a downward closing force on the upper feed drum of a predetermined constant load irrespective of the lateral position of the upper drum relative to the lower drum. The applied force to the cylinders increases with an increase in the fluid pressure to the motor.

One advantage of the present invention is that the hydraulic feed control system operates to apply a constant downward clamping pressure on the upper feed drum regardless of its position relative to the lower drum. Thus, unlike the prior tension spring systems, the same load is applied by the upper drum when the upper drum is in a substantially lowered position as when it is in a substantially raised position. This has the further advantage of applying the same compression load to small material fed to a small feed gap when the upper feed drum is only slightly spaced from the lower feed drum due to the size of the incoming material. The hydraulic feed control system thus does not suffer from the inherent limitations of a tension spring system whose applied load is governed by a spring constant which applies less load to the upper feed drum when the feed gap is small.

Another advantage of the invention is that the hydraulic feed control system operates off the line pressure to the feed drum motor. Under conditions where the motor of the feed drum has to work harder due to an increased load on the feed drum, the hydraulic feed control system automatically responds by applying corresponding greater pressure to the cylinder or cylinders and thus an increased downward clamping force of the upper feed drum on the material being fed through the gap. The increase in clamping pressure is not dependent on the pivot position of the feed drum, as with the prior tension springs, but on an increase of pressure of the fluid supplied to the feed drum motor.

According to a further aspect of the invention, the hydraulic feed control system is preferably controllable also in a manual mode through operator input in order to selectively actuate the cylinder to raise or lower the upper feed drum, if needed, to accommodate the introduction of large or awkward incoming feed material to the feed gap or to override the automatic mode to apply even greater downward pressure on the feed drum for enhanced gripping of adverse material. Once the manual control is released, the system is restorable to the automatic mode to apply the constant compression load to the feed material in order to grip and advance the material toward the reducing device within the apparatus.

Another advantage of the present invention is that it provides a simple solution to the inherent limitations of a tension spring and can be adapted to many chipping or grinding apparatus with little modification to the otherwise existing feed system.

THE DRAWINGS

The presently preferred embodiment of the invention is disclosed in the following description and in the accompanying drawings, wherein.

DETAILED DESCRIPTION

Figure 3:
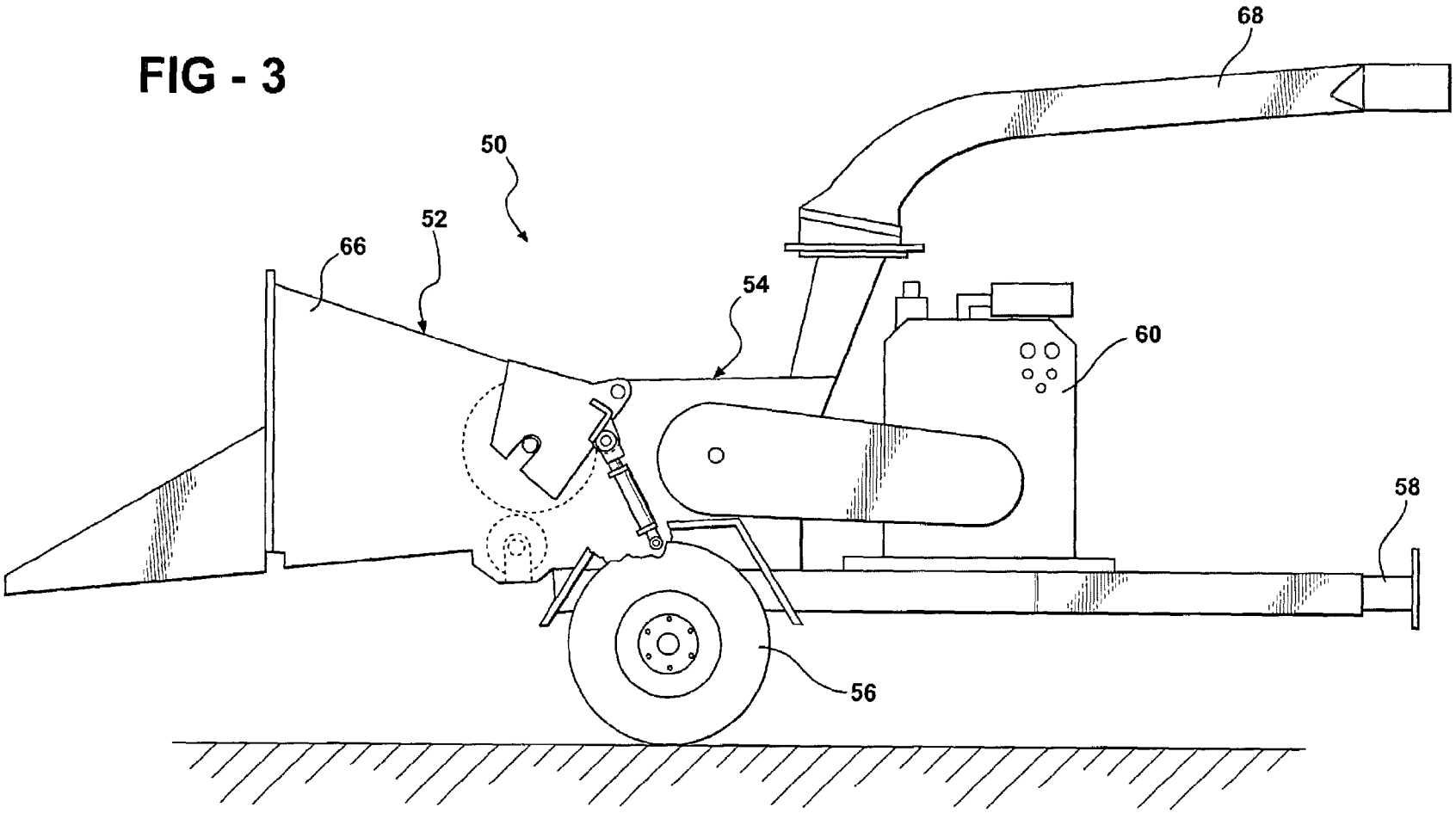
FIG. 3 is a side elevation view of a wood reducing apparatus constructed according to a presently preferred embodiment of the invention.
Figure 4:
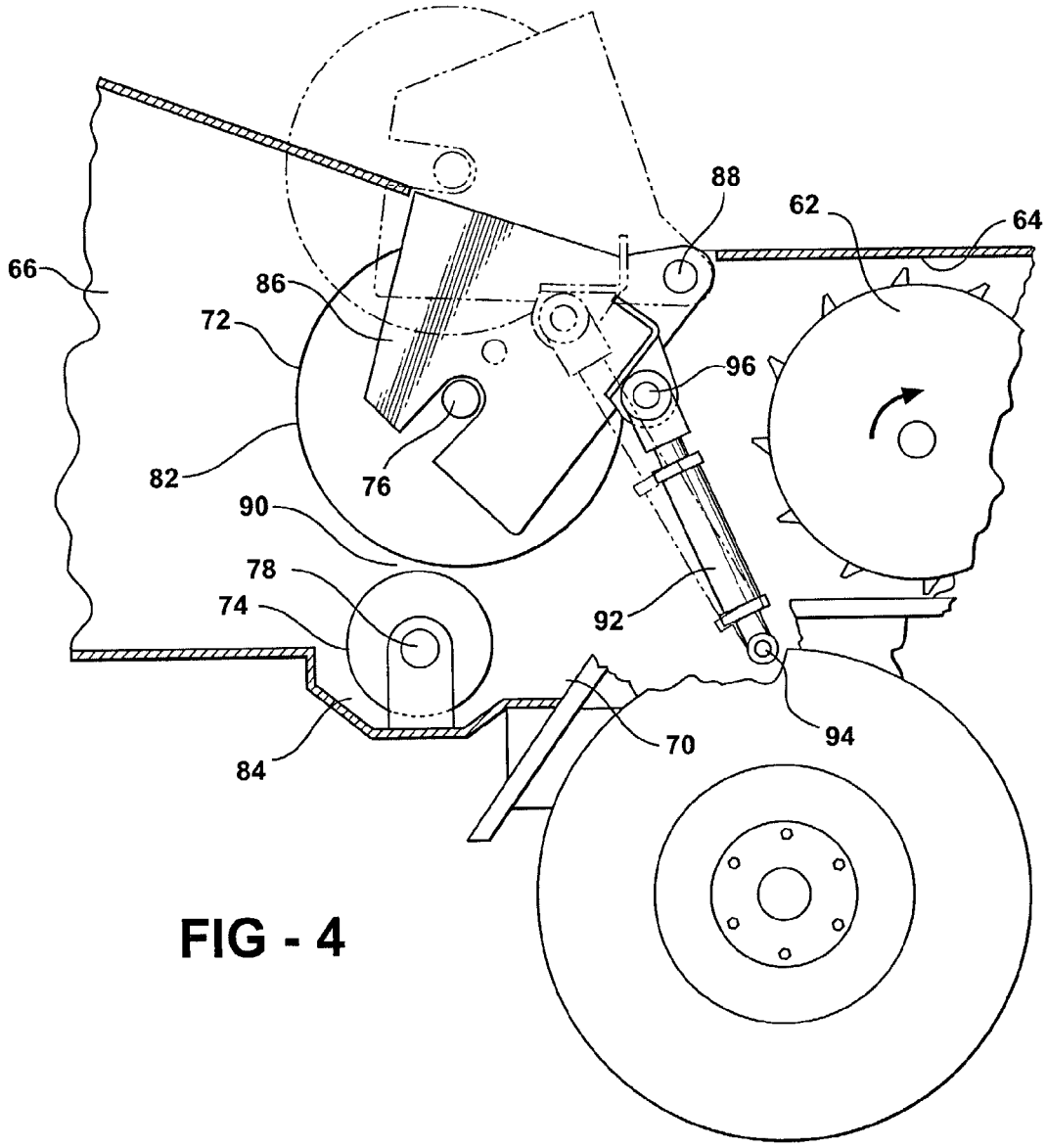
FIG. 4 is an enlarged, fragmentary sectional view illustrating features of the material feed device of the wood reducing apparatus of FIG. 3.
Figure 5:
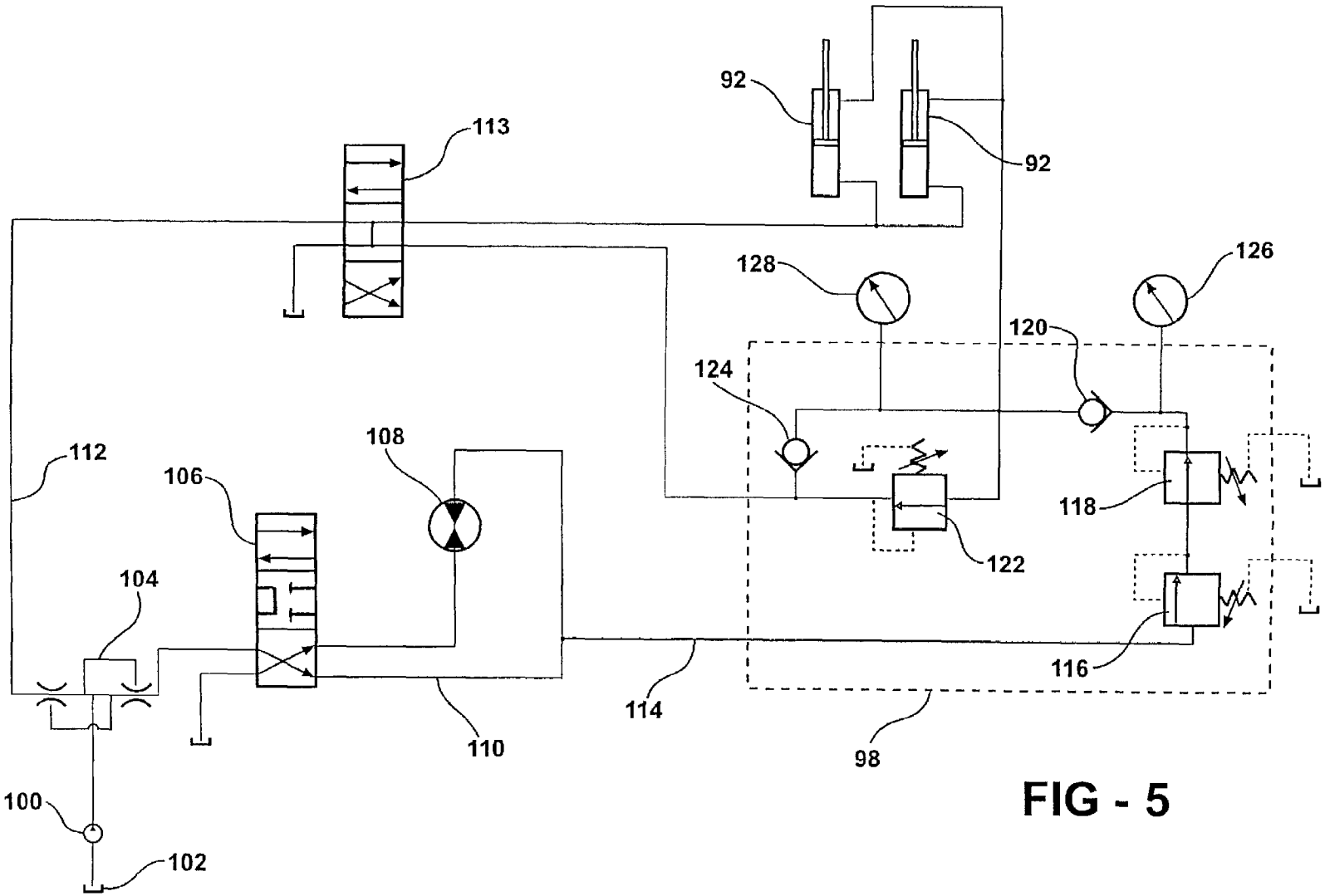
FIG. 5 is a schematic of a hydraulic feed control system associated with the feed device of FIG. 4.

One embodiment of a wood reducing apparatus 50 constructed according to the invention is shown in FIG. 3 incorporating an automatic hydraulic feed mechanism 52 of the invention which is additionally shown in FIGS. 4 and 5. The apparatus 50 shown in FIG. 3 in which the feed mechanism 52 is adapted happens to be, for purposes of illustration, a portable wood chipping apparatus of the usual type having a frame 54 supporting a set of wheels 56 and a tow hitch 58, and having an onboard engine 60 which drives a rotatable chipping drum 62 mounted within a chipping chamber 64 which communicates with an infeed chute 66 at one end and a discharge chute 68 at a discharge end. The feed mechanism 58 is mounted in a throat 70 of the infeed chute 66 upstream of the chipping drum 62. It will be appreciated that the subject feed system 52 is equally adaptable to other types of wood chipping or grinding apparatus where material is to be automatically fed to a rotating chipping or grinding mechanism to reduce the wood debris to chips or grindings, and such embodiments are incorporated herein by reference. Such additional embodiments include typically large stationary chipping and grinding apparatus which typically would not have wheels or a hitch and would be used, for example, to grind pallets and other scrap wood debris. The additional embodiments contemplated by the invention also include disc-type chippers and grinders.

Turning now more particularly to FIGS. 3 and 4, the feed mechanism 52 of the invention includes a set of upper and lower feed drums 72, 74 which are each supported for rotation about generally horizontal, parallel axles 76, 78 and having outer feed material gripping surfaces 82, 84 which are preferably cleated for improved gripping of the wood feed material. The upper feed drum 72 is positively driven in a counterclockwise direction as viewed in FIGS. 3 and 4 by a hydraulic motor. The hydraulic motor is shown in the schematic of FIG. 5 at 108 and is driven by a hydraulic constant displacement pump 100 which delivers a supply of hydraulic fluid to the motor 108 that is variable in pressure (e.g., between 200 and 2000 psi) through hydraulic line 83 with changes in load to the feed drum 72 to drive the upper feed drum 72. The pump 100 may be powered by an engine 60 or other means of power. The lower feed drum 74 is likewise driven, but in the opposite direction. The invention is thus adapted for working with whatever hydraulic drive system is available to positively rotate the feed drums 72, 74.

The upper feed drum 72 is supported on a swing arm 86 mounted by pivot connection 88 to the frame 54 and straddling the chamber 64 which enables the upper feed drum 72 to be moved or displaced laterally relative to the lower feed drum 74 in order to vary the size of a feed gap 90 defined between the outer surfaces 82, 84 of the feed drums 72, 74, respectively. As illustrated in FIG. 4, the upper feed drum 72 is movable between a fully lowered position shown in solid lines in which the outer surfaces 82, 84 are very near to one another to provide a relatively small feed gap 90, and a fully raised position illustrated by broken chain lines in FIG. 4 in which the upper feed drum 72 is raised further away from the lower drum 74 while maintaining the parallel relationship between their axes of rotation so as to provide a relatively larger feed gap 90.

At least one and preferably a pair of hydraulic cylinders 92 are mounted at their lower ends to the frame 54 by pivot mounts 94 and connected at their upper ends to the swing arms 86 by pivot mounts 96. The cylinders 92 are coupled to a hydraulic feed control system 98, the schematic of which is shown in FIG. 5.

The hydraulic feed control system 98 operates off the pressure of the hydraulic fluid delivered to the drum motor 108, and is operative in an automatic mode to constantly supply fluid under pressure to the upper ends of the cylinders 92 in such manner as to constantly urge the swing arm 86 and thus the upper feed drum 72 downwardly toward the lower feed drum 74 to apply a constant load to material fed into the gap 90, regardless of the position of the upper feed drum 72 relative to the lower feed drum 74, and thus the size of the gap.

Figure 1:
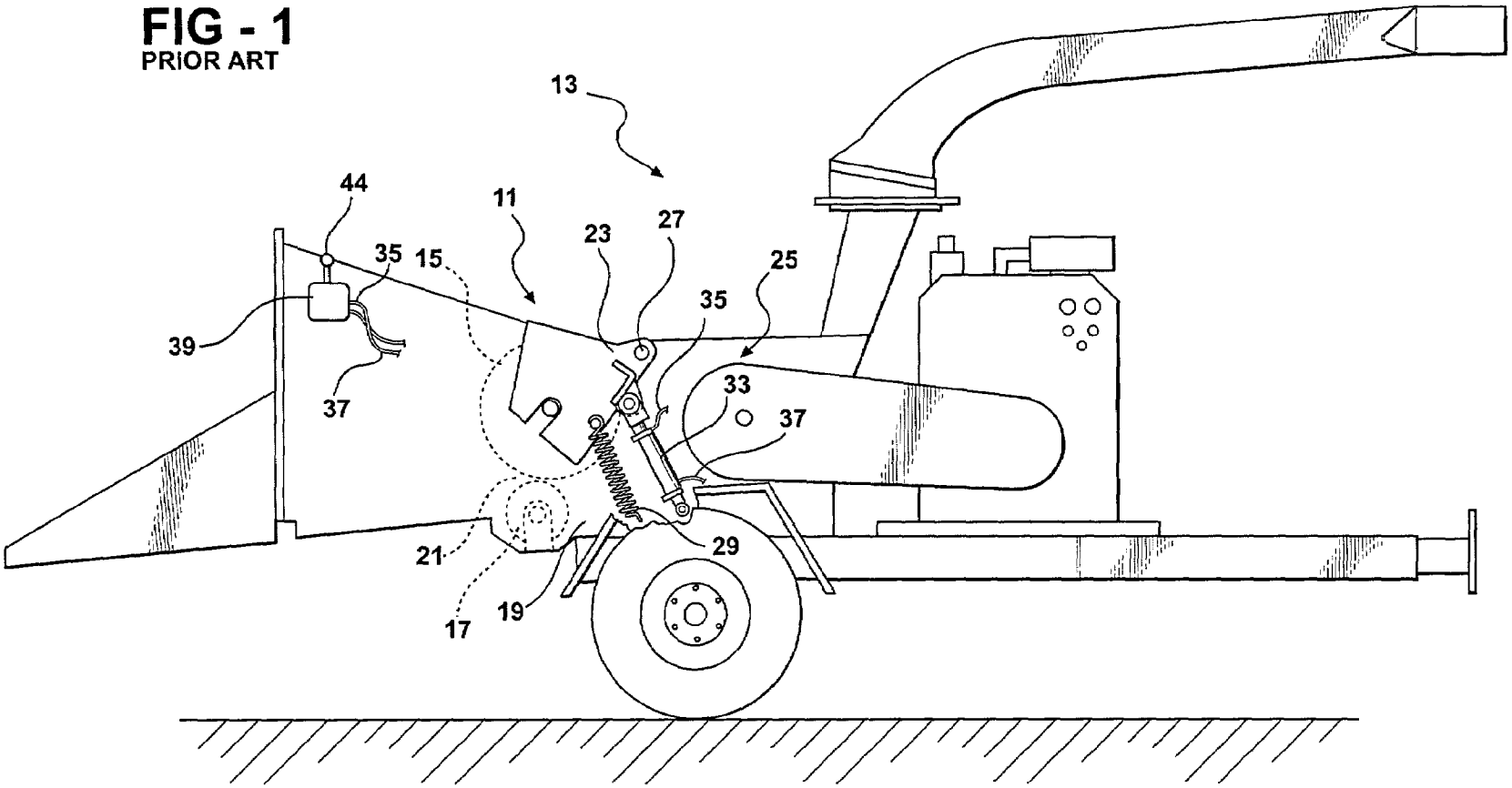
FIG - 1 PRIOR ART
FIG. 1 is a side elevation view of a prior art wood reducing apparatus.
Figure 2:
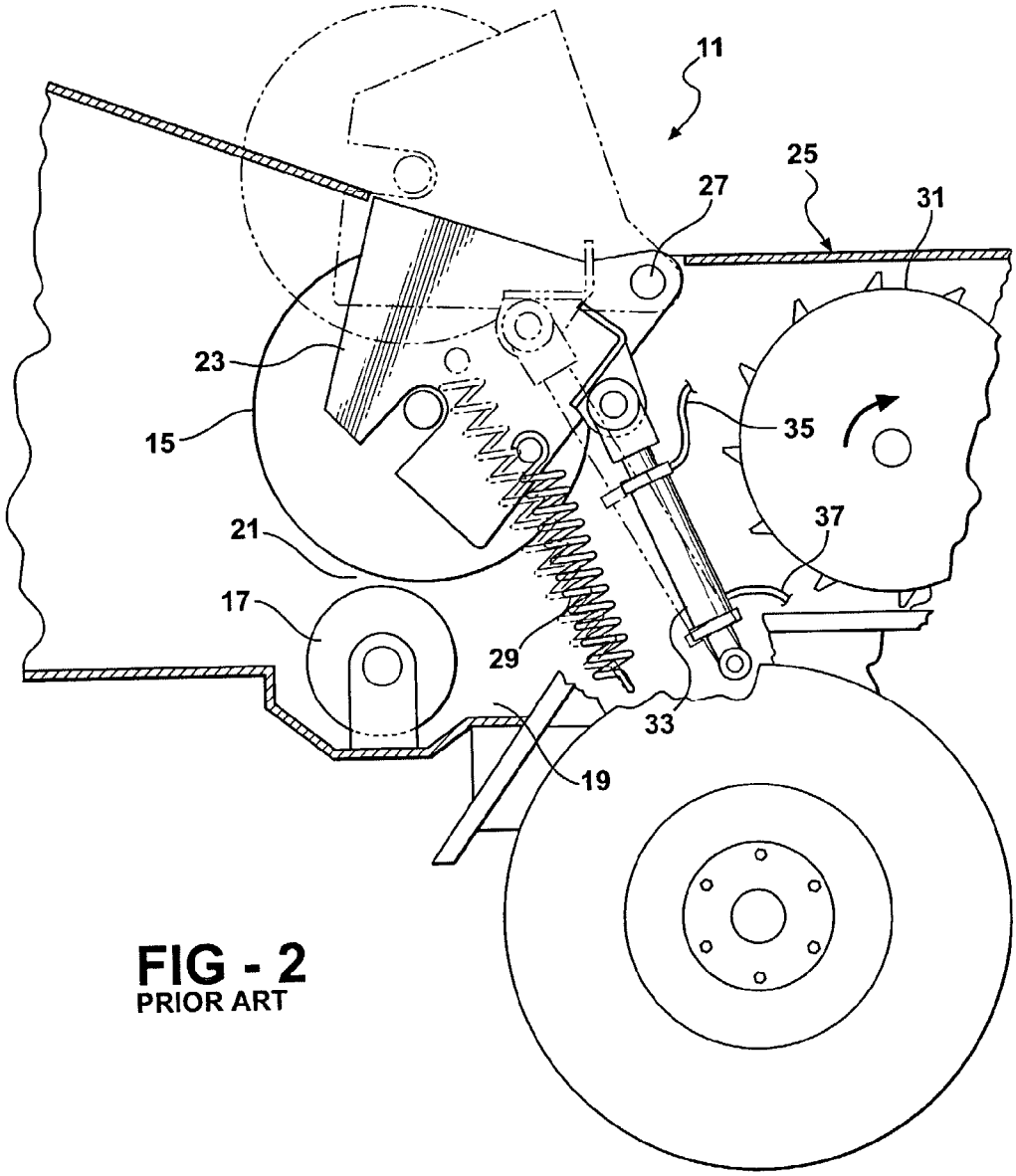
FIG - 2 PRIOR ART
FIG. 2 is an enlarged, fragmentary sectional view of the prior art feed system of the apparatus.

The system 98 is further operable in a manual mode to supply fluid under pressure to the lower end of the cylinder in order to selectively raise the swing arm 86 and thus the upper feed drum 72 away from the lower feed drum 74 to accommodate the introduction of large or awkward feed material into the gap 90. The system 98 is further operable in a manual mode to supply fluid under pressure to the upper end of the cylinders in order to exert additional down pressure on the feed drums beyond that provided in the automatic mode of operation. It will be observed from comparing FIGS. 3 and 1 that the apparatus 50 of the present invention lacks the usual pull down tension springs of the typical prior art device which normally acts to urge the feed drum downwardly. The tension spring and passive cylinder of the prior art are replaced according to the invention with the set of active cylinders 92 which operate in an automatic, dynamic mode to enable the upper feed drum 72 to be displaced relative to the lower feed drum 74 in order to vary the size of the gap 90 (i.e., variable position) while maintaining a constant, uniform downward load applied to feed material within the gap 90, regardless of the size of the gap 90. The system 98 is selectively operable in the manual mode as described above to widen the gap 90 if necessary to accommodate the initial infeeding of large or awkward materials, or to narrow the gap to apply added down pressure on the upper feed drum 72.

A schematic of the hydraulic system is shown in FIG. 5. The hydraulic pump 100 is driven by an engine 60, or the like, and draws hydraulic fluid from a reservoir 102 where it is pumped under pressure to a flow splitter 104. One part of the flow goes through a control valve 106 and is delivered to a hydraulic motor 108 through hydraulic line 110 for driving the upper feed drum 72. The pressure of the hydraulic fluid in line 110 is variable and depends upon the load on the feed drum 72. The hydraulic fluid pressure required to simply rotate the feed drum may be on the order of about 200 psi without any material being fed to the feed gap 90. Under load, the hydraulic pressure required to drive the feed drum 72 may vary greatly during the operation of the reducing device 50 up to a maximum hydraulic pressure of about 2000 psi. It will be understood that the range of 200 to 2000 psi is given by way of example in connection with the preferred embodiment, but those skilled in the art will appreciate that a larger or smaller range may be appropriate for a given application depending upon the requirement of the application, as might the value of the minimum and maximum operating pressures. Accordingly, the minimum pressure may be more or less than 200 psi and the maximum pressure may be more or less than 2000 psi.

The hydraulic feed control system 98 that operates the cylinders 92 in an automatic mode operates off the variable hydraulic fluid pressure delivered to the motor 108. As illustrated in FIG. 5, the feed control system 98 is coupled through a hydraulic line 114 to the line 110 associated with the hydraulic motor 108, and thus sees the same variation in pressure in line 114 as that in line 110. The feed control system 98 may include a first pressure relief valve 116 to prevent overpressure of hydraulic fluid to the other components down line of the pressure relief valve 116. However, not all applications of the hydraulic feed control system 98 require the pressure relief valve 116 and it is thus optional.

The hydraulic feed control system 98 includes a pressure reducing valve 118 that is exposed on its up line side to the variable pressure in lines 110 and 114 associated with the feed motor 108 (e.g., 200 to 2000 psi). The pressure reducing valve 118 operates as a pressure governor to set a maximum pressure limit of hydraulic fluid down line of the pressure reducing valve 118 coming from the infeed lines 110, 114 to a set pressure above that of the minimum operating pressure of the motor 108, but below the maximum operating pressure. For example, the pressure reducing valve 118 in the preferred embodiment is set to 800 psi, such that the hydraulic pressure in the system 98 down line of the pressure reducing valve 118 in the automatic mode which operates the feed wheel cylinders 92 to exert downward force on the feed drum 72 is in the range of the minimum operating pressure associated with the feed motor 108 up to a maximum of the set valve (e.g., 800 psi) of the pressure reducing valve 118.

A check valve 120 is arranged in line between the pressure reducing valve 118 and the first or upper end of the cylinders 92. The check valve 120 is arranged to prevent back pressure of hydraulic fluid from the cylinders 92 to the pressure reducing valve 118. The invention contemplates that the check valve 120 may not be necessary in all applications, wherein the pressure reducing valve 118 operates to govern the maximum pressure into the system 98 and may also operate to check the back pressure from the system 98 back to the lines 110, 114. In the embodiment shown, the check valve 120 is present and serves as a primary check against back pressure from the system 98 back through the lines 110, 114.

The system 98 further includes another check valve 124 formed with a pilot bleed hole open to a reservoir dump through a manual control valve 113 and operates to relieve stored fluid pressure from the system 98 by bleeding hydraulic fluid as necessary to the reservoir when the system 98 transitions from a relatively higher pressure condition (high load on the feed drum 72) to a relatively lower fluid pressure condition (reduced load on the feed drum). The system 98 further includes a pressure relief valve 122 which is disposed in line between the upper or first end of the feed drum cylinders 92 and the reservoir dump of the control valve 113. The pressure relief valve 122 is set to a relief pressure greater than the set pressure of the pressure reducing valve 118, but less than that of the maximum of the operating pressure of the feed motor 108. In the preferred embodiment, the pressure relief valve is set at 900 psi, such that the hydraulic pressure downline of the pressure reducing valve up to the maximum of 800 psi is maintained in the system 98 and directed to the first end of the feed drum cylinders 92 to urge the feed drum 72 downwardly in the automatic mode at whatever pressure is present in the line 110 driving the motor 108, up to a maximum of 800 psi associated with the pressure relief valve 118.

The system 98 may further include diagnostic gauges 126, 128 which may be used to set the desired pressure limits of the pressure reducing valve 118 and pressure relief valve 122, respectively.

In the automatic mode of operation, the hydraulic pressure in line 110 needed to drive the feed motor 108 to rotate the feed drum 72 prior to the introduction of any material to the feed gap 90 is at the minimum (e.g., 200 psi). This 200 psi is likewise present in line 114 and thus in the top end of the cylinders 92. As wood debris material is fed to the gap 90, the feed drum 72 is caused to climb up onto the material, pivoting the swing arms 86 upwardly. This upward movement of the swing arms 86 draws the pistons of the cylinders 92 upwardly, pushing the hydraulic fluid out of the upper or first end of the cylinders 92. As shown in the schematic of FIG. 5, the fluid escaping the upper end of the cylinders 92 encounters the pressure relief valve 122 and, when the pressure exceeds 900 psi, the pressure relief valve 122 opens, dumping the excess fluid to the reservoir through the control valve 113. Once the pressure drops below 900 psi, the pressure relief valve 122 closes.

As the load on the feed drum 72 increases, due to a variety of factors such as heavy or awkward wood debris fed to the gap 90, the pressure of the hydraulic fluid delivered from the pump 100 to the motor 108 increases up to a maximum of 2000 psi to drive the drum 72 with increased torque. This increase in hydraulic fluid pressure in line 110 is likewise transmitted to line 114 and to the feed control system 98. The pressure reducing valve 118 allows any increase, up to 800 psi, to be transmitted directly to the upper end of the cylinders 92, forcing the swing arm 86, and thus the feed drum 72 downwardly to effect an increase in clamping force on the debris present in the gap 70 between the upper and lower feed wheels 72, 74. It will thus be seen that the feed control system 98 operates in the automatic mode off the variable pressure, and is insensitive to the position of the drum 72 or the width of the feed gap 90, unlike the prior spring tension system. As the load on the feed drum 72 drops back to a lower level, for example back to 200 psi, the elevated pressure present in the system 98 (up to 800 psi) is relieved through the metered leakage of the pressurized fluid through the bleed hole of the check valve 124 to the reservoir associated with the control valve 113 until such time as the pressure in the system 98 equals that present in the lines 110 and 114.

If, when operating in the automatic mode, the operator desires to increase the downward pressure exerted by the upper feed drum 72 on the material above that available through the automatic mode of operation (i.e., exceeding 800 psi down pressure in the cylinders 92), the operator can move a lever of the control valve 113 to a "down" position, whereby hydraulic fluid pressure in line 112 from the other side of the flow splitter 104 generated by the pump 100 directs hydraulic fluid pressure under an elevated pressure (e.g., 1500 psi) into the system 98 through the check valve 124 where it is applied to the first or upper end of the cylinders 92 to exert the increased downward force on the upper feed drum 72. The control valve 113 may be fitted with a port relief valve which sets the manual down pressure exerted on the cylinders to a maximum below the maximum pressure delivered from the pump 100 (e.g., set at 1500 psi, below the 2000 psi available from the pump 100) to prevent overpressurization of the cylinders 92, if desired. Once the "down" lever is moved back to a neutral position, any excess pressure in the system 98 bleeds back through the pressure relief valve 122 until it equalized with the line pressure in lines 110 and 114 in the automatic mode.

If the operator wishes to manually raise the feed drum 72 in order to assist the drum in climbing up and over wood debris fed to the gap 90, the operator may move a lever of the control valve 113 to a "up" position, which directs the hydraulic fluid from line 112 through control valve 113 under elevated pressure (e.g, 1500 psi) to the second or lower end of the cylinders 92, forcing the pistons of the cylinder 92 upwardly. The upper movement of the pistons forces the fluid in the first or upper end of the cylinders 92 out of the cylinders where it is discharged through pressure relief valve 122 to the reservoir dump associated with the control valve 113. Upon returning the lever from the "up" to a neutral position, the system 98 returns to the automatic mode of operation described above.

The disclosed embodiment is representative of a presently preferred form of the invention, but is intended to be illustrative rather than definitive thereof. The invention is defined in the claims.

We claim:

1. Apparatus for mechanically reducing wood debris, comprising:

a housing having a material infeed chute;

a mechanical reducing device disposed within said housing operative to reduce the wood debris material fed into said housing;

at least one feed drum supported within said housing between said infeed chute and said mechanical reducing device for rotation about a generally horizontal axis and further supported for selective raising and lowering within the housing relative to a lower material support to provide a variable width feed gap to accommodate variations in the size of the wood debris material introduced to said feed gap;

a hydraulic motor coupled to said at least one feed drum and to a supply of hydraulic fluid under pressure to drivingly rotate said at least one feed drum, said fluid pressure being variable in response to varying loads exerted on said at least one feed drum; and a hydraulic feed control system coupled to said at least one feed drum and to said supply of hydraulic fluid and operative to exert a downward force on said at least one feed drum in response to application of a load on said at least one feed drum and thus an increase in said hydraulic fluid pressure associated with said at least one feed drum.

2. The apparatus of claim 1 wherein said hydraulic feed control system includes at least one fluid cylinder.

3. The apparatus of claim 2 wherein said hydraulic feed control system includes a pair of fluid cylinders.

4. The apparatus of claim 3 wherein said housing includes a swing arm mounting said at least one feed drum for rotation about a drum axis of the at least one feed drum and pivoted to a support of said housing at a pivot axis spaced laterally from said drum axis.

5. The apparatus of claim 3 wherein said hydraulic feed control system includes a pressure reducing valve disposed in line between said supply of hydraulic fluid and a first side of said cylinders operative when pressurized to exert said downward force on said at least one feed drum, said pressure reducing valve being operative to set a maximum fluid pressure limit applied to said one side of said cylinders when said system is operating in an automatic mode that is less than a maximum operating pressure of said supply of hydraulic fluid.

6. The apparatus of claim 5 wherein said hydraulic feed control system includes a pressure relief valve disposed in line between said first side of said cylinders and a reservoir, said pressure relief valve being set at a higher relief pressure that said maximum fluid pressure limit of said pressure reducing valve.

7. The apparatus of claim 6 wherein said hydraulic feed control system includes a first check valve disposed in line between said pressure reducing valve and said first side of said cylinders.

8. The apparatus of claim 7 wherein said hydraulic feed control system includes a second check valve formed with a pilot hole for relieving fluid pressure from said hydraulic fluid control system.

9. The apparatus of claim 8 wherein said control valve is operative in a manual "down" pressure applying condition to direct hydraulic fluid under pressure exceeding that of the maximum fluid pressure limit associated with the automatic mode of operation to said first side of said cylinders for applying increased downward pressure on said at least one feed drum exceeding that applied to said at least one feed drum when said system is operating in said automatic mode.

10. The apparatus of claim 9 wherein said control valve is further operable in a manual "up" pressure applying condition to direct hydraulic fluid under pressure to a second side of said cylinders for manually raising said at least one feed drum to under said feed gap.

11. The apparatus of claim 1 wherein said lower material support comprises a lower drum rotatable in an opposite direction to that of said at least one feed drum.

* * * * *